United States Patent [19]

Bader

[11] 4,112,980

[45] Sep. 12, 1978

[54] LOOM HARNESS

[75] Inventor: Hartmann Bader, Winterthur, Switzerland

[73] Assignee: Sulzer Brothers Limited, Winterthur, Switzerland

[21] Appl. No.: 783,960

[22] Filed: Apr. 1, 1977

[30] Foreign Application Priority Data

| | | | |
|---|---|---|---|
| Apr. 8, 1976 | [CH] | Switzerland | 4421/76 |
| Feb. 15, 1977 | [CH] | Switzerland | 1836/77 |
| Feb. 15, 1977 | [CH] | Switzerland | 1837/77 |

[51] Int. Cl.[2] ..... D03C 9/06

[52] U.S. Cl. ..... 139/92

[58] Field of Search ..... 139/91, 92, 82, 88

[56] References Cited

U.S. PATENT DOCUMENTS

| | | | |
|---|---|---|---|
| 2,944,571 | 7/1960 | Pfarrwaller | 139/91 |
| 3,352,329 | 11/1967 | Koch | 139/92 |
| 3,434,505 | 3/1969 | Koch | 139/92 |
| 3,889,721 | 6/1975 | Wagner | 139/91 |
| 3,895,655 | 7/1975 | Sujdak et al. | 139/92 |
| 3,948,296 | 4/1976 | Koch | 139/91 |
| 3,970,114 | 7/1976 | Baumann | 139/91 |

FOREIGN PATENT DOCUMENTS

| | | | |
|---|---|---|---|
| 943,918 | 10/1948 | France | 139/92 |
| 434,144 | 10/1967 | Switzerland | 139/92 |

*Primary Examiner*—James Kee Chi

*Attorney, Agent, or Firm*—Werner W. Kleeman

[57] ABSTRACT

A loom harness comprising a harness frame composed of longitudinal and transverse beams and at least one holder element mounted at one of the beams for mounting a further member, for instance a transverse strut or heddle rail. Between the holder element and the beam carrying the same there is interposed at least one elastic intermediate element through which there is transmitted the force flux between the holder element and the beam.

11 Claims, 33 Drawing Figures

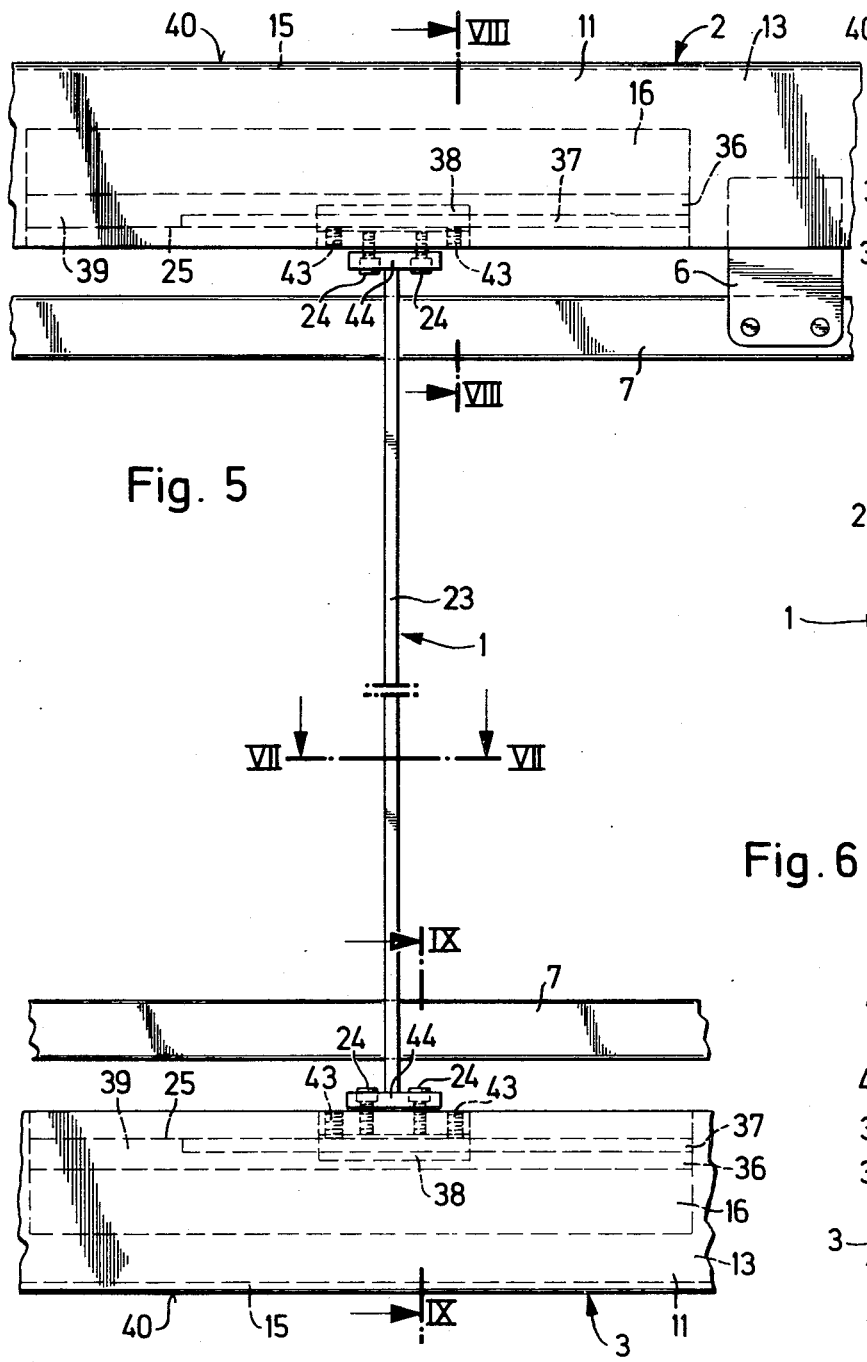
Fig. 5
Fig. 6
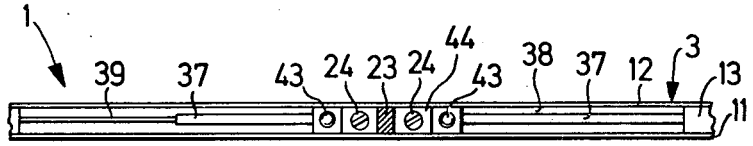
Fig. 7

LOOM HARNESS

BACKGROUND OF THE ELEMENT

The present invention relates generally to loom harnesses, and, more specifically, to a new and improved construction of loom harness which comprises a harness frame composed of longitudinal beams, the so-called top and bottom rails or shafts, and transverse beams, usually referred to as side struts, and containing at least one holder element mounted at one of the beams for mounting a further member or element, for instance a transverse strut or heddle rail.

With prior art harnesses of this type the holder elements are rigidly mounted at the related frame beam, for instance welded, riveted or threadably connected thereat, as taught for example in German Pat. No. 1,083,759, or embedded in a connection material for both walls of the frame beam such as taught for instance in Swiss Pat. No. 434,144. Therefore, during bending and vibration of the harness and its individual parts, the holder elements may be exposed to pronounced loads, so that they tend to rupture or permanently deform.

SUMMARY OF THE INVENTION

Thus, with the foregoing in mind it is a primary object of the present invention to provide a new and improved construction of harness which is not associated with these drawbacks and limitations of the prior art constructions.

Another and more specific object of the present invention aims at a novel construction of loom harness wherein forces applied to the harness frame during the operation of the loom, typically during the shedding motion, and transmitted between the holder elements and the frame beam at which such holder element or elements are attached are cushioned in a manner such that excessive undesired loading of such holder elements is precluded or at least substantially minimized.

Yet a further significant object of the present invention relates to novel constructions of harness frames wherein the forces applied thereto during operation of the loom are taken-up in a controlled manner to safeguard against undesired loading and thus possible rupture or permanent deformation of holder elements carried by the harness frame.

Now in order to implement these and still further objects of the invention, which will become more readily apparent as the description proceeds, the harness of this development is manifested by the features that between the holder element and the beam carrying the same there is incorporated at least one elastic intermediate element or piece, for instance formed of rubber, through which there is transmitted the force flux i.e. forces which flow between the holder element and the associated beam. By virtue of such construction there is effectively avoided, or at least minimized, the possibility of rupture and bending of the holder elements and the members or parts retained thereat. Also, with this design there is obtained the beneficial result that a particularly effective sound damping of the parts is realized, promoting quieter loom operation.

According to an exemplary embodiment of the present invention, there is arranged at the harness frame of the loom harness a mounting device for the member, this mounting device being fixed or clamped at the respective sides of the holder element which confront and face away from such mounting device. In this way, there is realized a particularly operationally reliable mounting of the member at the harness frame beam. Finally, with the harness construction of the present invention there is also realized tolerance compensation of the parts joined together by means of the holder elements, namely, on the one hand, the longitudinal beam or rail of the harness, and, on the other hand, the intermediate struts, heddle rails and so forth.

A further exemplary embodiment of the invention contemplates engaging the elastic intermediate element by a recess or boundary surface of the holder element. With this design there is likewise obtained a positive and nonetheless elastic attachment of the holder element and the further member mounted thereat.

BRIEF DESCRIPTION OF THE DRAWINGS

The invention will be better understood and objects other than those set forth above, will become apparent when consideration is given to the following detailed description thereof. Such description makes reference to the annexed drawings wherein generally the same reference characters have been used for the same or analogous components and wherein:

FIG. 5 is a fragmentary view of a portion of a modified construction of loom harness;

FIG. 6 is a longitudinal view, partly in section, of the harness frame illustrated in FIG. 5;

FIG. 7 is a cross-sectional view thereof, taken substantially along the line VII—VII of FIG. 5;

DETAILED DESCRIPTION OF THE PREFERRED EMBODIMENTS

Figure 1:
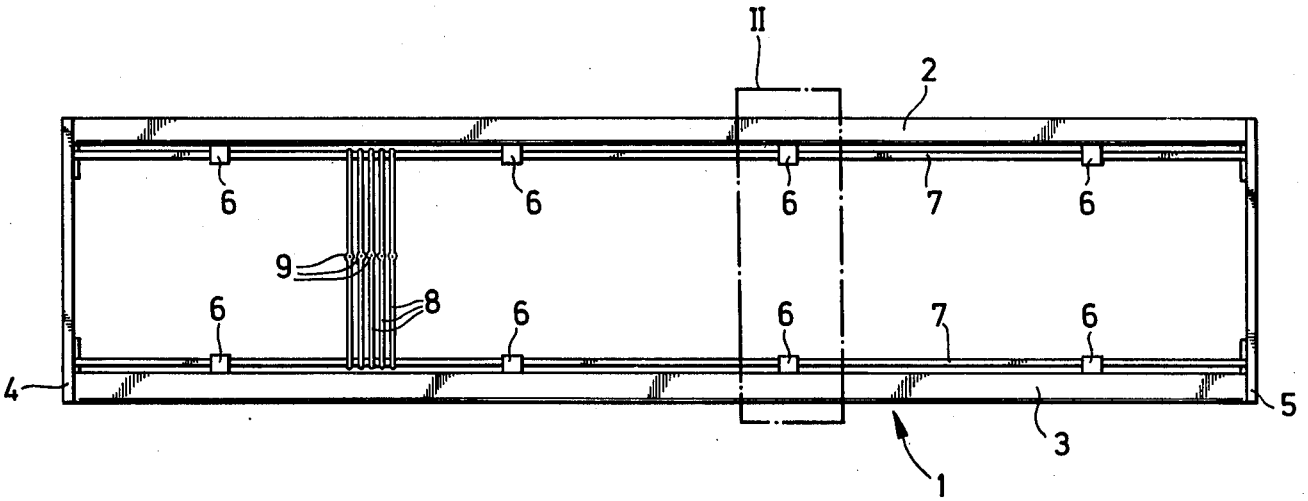
FIG. 1 is a schematic front view of a loom harness including a harness frame constructed according to the teachings of the present invention.
Figure 2:
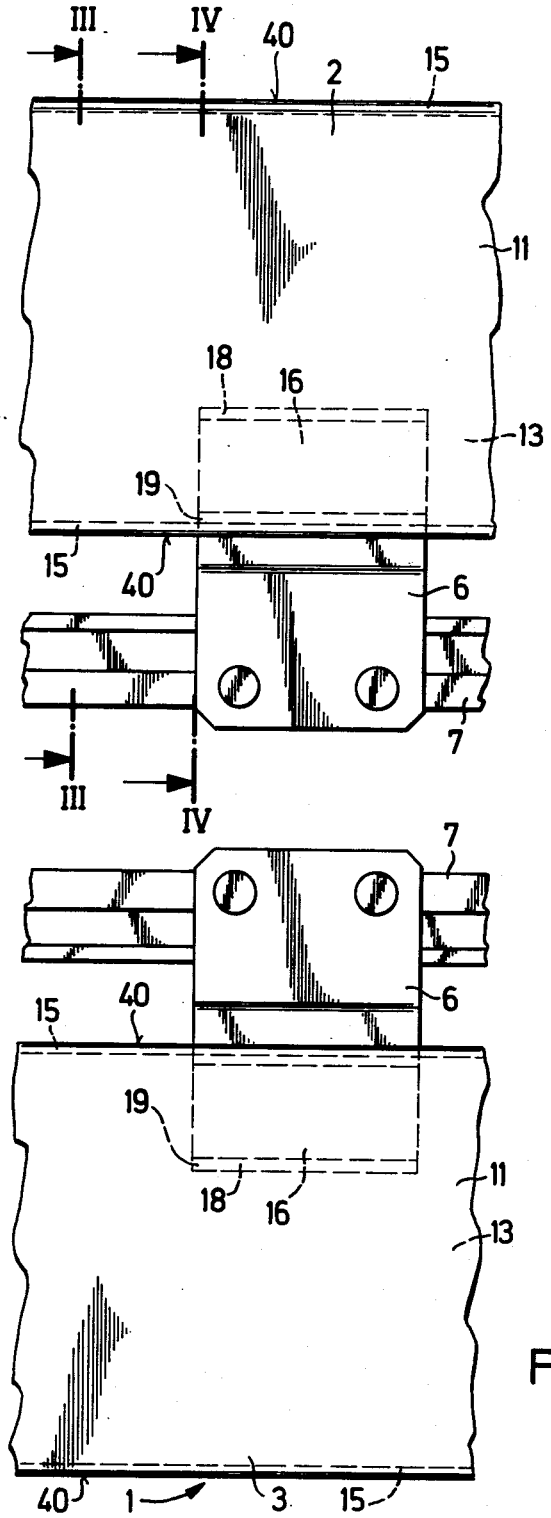
FIG. 2 is a simplified fragmentary front view, on an enlarged scale, of that portion of the harness frame of FIG. 1 enclosed in the rectangle designated by reference character II.

Describing now the drawings, and turning attention to the exemplary embodiment of loom harness shown in FIG. 1, and generally designated in its entirety by reference character 1, it will be understood that such comprises a harness frame composed of two longitudinal beams 2 and 3 defining top and bottom rails or shafts and two transverse beams 4 and 5 arranged essentially perpendicular thereto and defining end or side struts. Heddle rails 7 are mounted by means of the holders or holder elements 6 at the longitudinal beams 2 and 3. Strung onto these heddle rails 7 are warp thread heddles 8 in a manner well-known in this particular art. The warp ends or threads, which have not been especially shown, are threaded through the eyelets 9 of the heddles 8 and, during operation of the loom, these warp threads are moved in conventional fashion up-and-down by the harness while forming the shed during the shedding motion.

Figure 3:
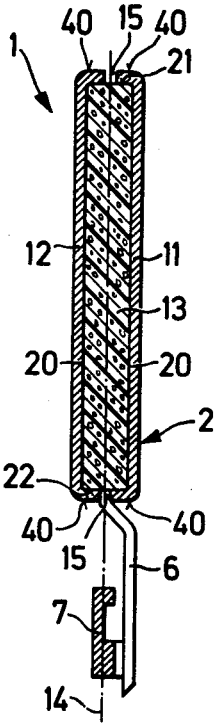
FIG. 3 is a sectional view through the upper longitudinal beam of the harness frame, taken substantially along the line III—III of FIG. 2.
Figure 4:
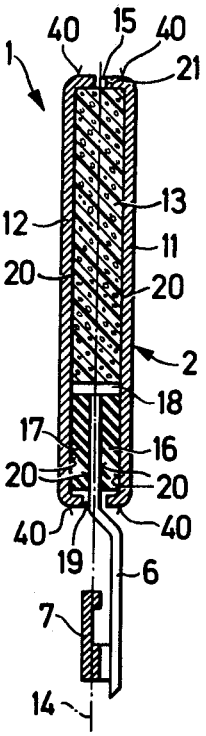
FIG. 4 is a sectional view through the upper longitudinal beam of the harness frame, illustrated in FIG. 2, taken substantially along the line III—III thereof.

Each longitudinal beam 2 and 3 will be seen from FIGS. 3 and 4 to comprise two respective supporting or support walls 11 and 12, which, for instance, may be formed of steel, aluminum or fiber reinforced plastics. In the intermediate space between the confronting support walls 11 and 12 there is arranged a filler material or core 13, for instance formed of a rigid foamed plastic, a honeycomb-like material, a light species of wood, for example balsa wood, cork or plastic. This core 13 is for instance adhesively bonded at the adhesive surfaces, generally indicated by reference character 20, to the support walls 11 and 12. Further, the walls 11 and 12 are arranged substantially parallel to the plane 14 of the harness. When using steel, the damping coefficient is approximately 0.0004, with rigid polyvinyl chloride foam approximately 0.1 and with cork approximately 0.2. The filler material or core 13 forms the sole connection between both walls 11 and 12. In order to protect the narrow or end surfaces 21 and 22 of the core 13, the walls 11 and 12 are bent along their longitudinal or lengthwise extending edges 40 in such a manner that there remains a gap or space 15 between the confronting walls 11 or 12, as best seen by referring to FIG. 3. Filler material or core 13 provides effective sound damping during operation of the loom harness.

As will be recognized by referring to FIG. 4, the holders or holder elements 6 for the heddle rail 7 are connected by means of rubber elastic or elastomeric bodies or body members 16 and 17 with the walls 11 and 12 of the longitudinal beams 2 and 3, for instance by adhesively bonding the elastomeric bodies 16 and 17 to the walls 11 and 12, so that there is possible a slight to-and-fro movement in the direction of the plane 14 of the harness frame. This is rendered possible by providing a gap or space 18 between the upper end of the elastomeric or rubber body members 16 and 17 and its associated holder or holder element 6 on the one hand and the core 13 on the other hand, as well as by the provision of a wider gap or space 19, at the region of the holder element 6, between the walls 11 and 12. The bodies or body members 16 and 17 allow adequate shifting of the walls 11 and 12 towards the holder element 6 and additionally provide for sound damping between the holders or holder elements 6 of the heddle rails 7 and the walls 11, 12 of the longitudinal beams 2 and 3. A further possible modification which has not been particularly illustrated, but readily understandable from the foregoing disclosure, would be to eliminate the use of one of the elastomeric or rubber bodies 16 or 17. At this point it is mentioned that the term "elastomeric" as used herein is employed in its broader sense to include rubber and rubber-like synthetic or natural materials.

Continuing, with the modified loom harness 1 shown in FIG. 5 displaceable intermediate struts 23 are distributively and removably mounted over the length of the harness frame.

Figure 8:
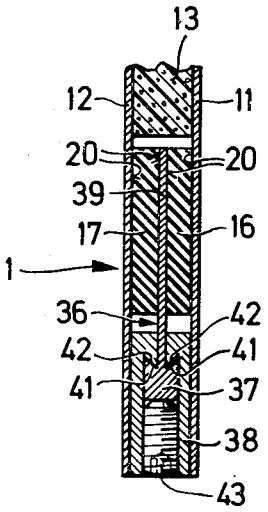
FIG. 8 is a cross-sectional view thereof, taken substantially along the line VIII—VIII of FIG. 5.
Figure 9:
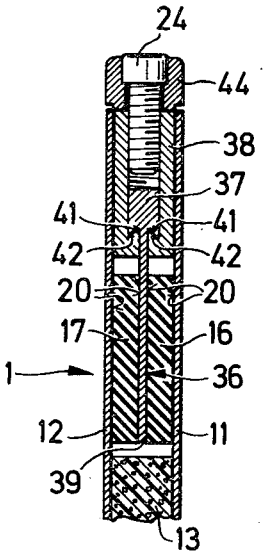
FIG. 9 is a cross-sectional view thereof, taken substantially along the line IX—IX of FIG. 5.

At the region of each intermediate strut 23 there is arranged a profile or structural rail 36, defining a holder element, between the walls 11 and 12. Such profile rail 36 is fixedly connected, for instance by providing a suitable adhesive bond, with the walls 11 and 12 by means of the elastomeric or rubber elastic bodies 16 and 17. Further, the profile rail 36 will be seen to contain at its edge facing towards the center of the harness frame an enlarged portion or part 37 which, as shown in FIG. 8, possesses a substantial dovetail configuration. This enlarged portion 37 is constructed such that at the transition between its thinner portion or part 39 and such enlarged portion or part 37 there is formed to both sides groove or channel means 41. A displaceable element 38 engages in such groove means 41 by means of both of its substantially hook-shaped ends 42. Also as best seen by referring to FIG. 8, through the use of a threaded pin or screw 43 or equivalent structure this displaceable or sliding element 38 is clamped at the profile rail 36 in such a manner that the ends 42 are drawn into the grooves or groove means 41. At the opposite ends of each intermediate strut 23 there is attached a respective base element 44 which extends transversely with respect to its intermediate strut 23. Each intermediate strut 23 is connected by means of the base elements 44 with the displaceable or sliding elements 38 located at the opposite strut ends, for instance with the aid of screws 24 or equivalent fastening expedients. At one end of each of the profile rails 36 there is omitted along a length 25 which corresponds at least to the length of the displaceable or shiftable element 38, the dovetail part corresponding to the enlarged portion or part 37 above described. At this region the displaceable element 38 can be conveniently removed and replaced.

The elastomeric bodies 16 and 17, each formed of one part, and disposed to opposite sides of the profile rail 36, as shown, also can be composed of a number of elastomeric elements arranged in spaced juxtaposition. In this way, there can be obtained a further rubber elastic or rubber-like connection between the profile rails 36 and the walls 11 and 12 of the longitudinal beams 2 and 3.

According to a further modified version of loom harness the transverse beams or end struts 4 and 5 and/or the intermediate struts 23 are formed of two walls interconnected by the filler material or core, and corresponding to the parts 11 to 13 above discussed. If desired, there also can be provided between the outer walls 11 and 12 one or a number of walls located approximately in the harness plane 14 and between which there is arranged filler material 13.

Figure 10:
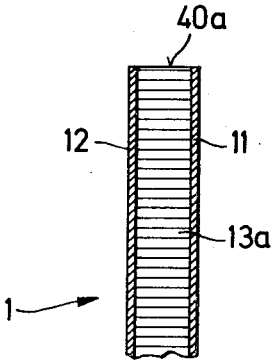
FIG. 10 is a fragmentary sectional view of a further variant of loom harness.
Figure 11:
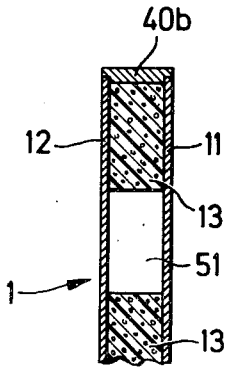
FIG. 11 illustrates in sectional view a still further embodiment of loom harness.

The structure of the filler material 13 can be different. For instance, in the intermediate space between the walls 11 and 12 there can be interposed a filler material having a substantially honeycomb-like structure 13*a*, as shown in FIG. 10, or, also a filler material possessing longitudinal hollow cavities or spaces 51, as shown in FIG. 11. Also the shaping or profiling of the body members or bodies 16 and 17 can be different from that illustrated, for instance they can possess hollow spaces or cavities, grooves and so forth.

In all of the herein disclosed embodiments, the force flux, i.e., the flow of the forces between the beams 2 and 3, i.e., their walls 11 and 12 on the one hand and the holder elements 6, 36 on the other hand, is transmitted through the agency of elastic intermediate elements or bodies 16 and 17, not directly from the relevant harness frame beams and their walls to the related holder element.

Figure 12:
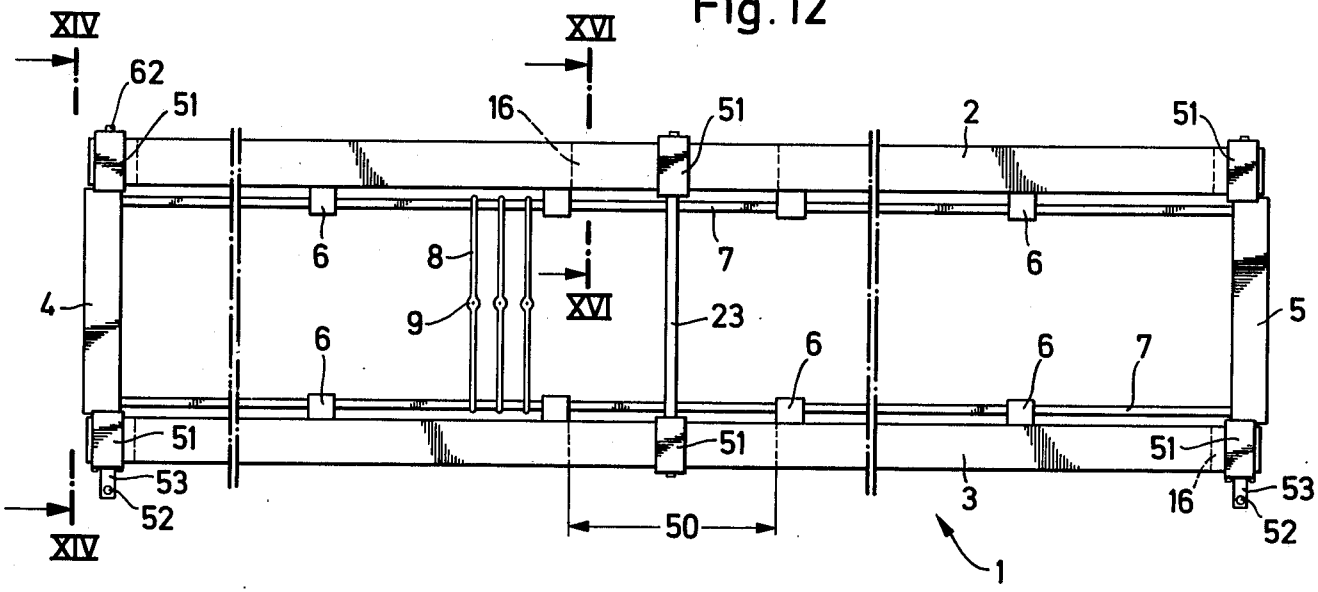
FIG. 12 is a schematic front view of a further construction of loom harness incorporating a harness frame according to the present invention.

The harness frame of the loom harness 1 illustrated in FIG. 12 will be seen to contain an intermediate strut 23. This harness 1 is driven by conventional and therefore not particularly illustrated drive hooks or lifters or equivalent means which are articulated at locations 52 at the holder elements 53. The holder elements 53 are here constructed as eyelets. As shown for the modified construction of FIG. 17, the longitudinal beam 3 can be provided with a hook 71 with which there can engage an appropriate counter-hook which, for instance, may be attached to an up-and-down movable drive hook or lifter or the like.

The components or parts 4, 5, 23, 53 and 71 are attached by means of mounting or clamping devices 51 at the longitudinal beams 2 and 3, and the construction of such mounting devices 51 will be explained more fully hereinafter. In particular, each such mounting or clamping device 51 contains a sleeve or collar, generally indicated in its entirety by reference character 54, which engages by means of its two legs 55 and 56 about the walls 11 and 12, respectively, of the related longitudinal beam 2 and 3. Between the walls 11 and 12 there is arranged a holder plate or rail 36. Elastic intermediate elements or bodies 16 and 17 are inserted between the plate 36 and the walls 11 and 12, for instance by being vulcanized or adhesively bonded therein. The intermediate elements or bodies 16 and 17 are formed of, for instance, rubber and are arranged at a neighboring region of the mounting or clamping device 51, as indicated for instance by reference character 50 in FIG. 12. The legs 55 and 56 engage with their flexed or bent ends 57 behind a substantially U-shaped base element or base 58 which is attached, for example by welding the same, to the neighboring end 59 of the transverse or side beam 4. The base element 58 is supported against a lengthwise extending enlarged portion 37 of the holder plate 36. At the upper end of the legs or leg members 55 and 56 the same are connected, as by welding, with a head piece or element 61 containing a clamping bolt or tightening screw 62 or equivalent. Between this clamping bolt or screw 62 and an upper longitudinal or lengthwise extending enlarged portion 37*a* of the holder plate or element 36 there is interposed a tension or clamping spring 63 which bears at locations 64 and 65 against the enlarged portion or part 37*a*. By tightening the screws 62 the parts 4 and 58 of FIGS. 13 and 14 are drawn upwardly and clamped against the longitudinal beam 2.

Figure 13:
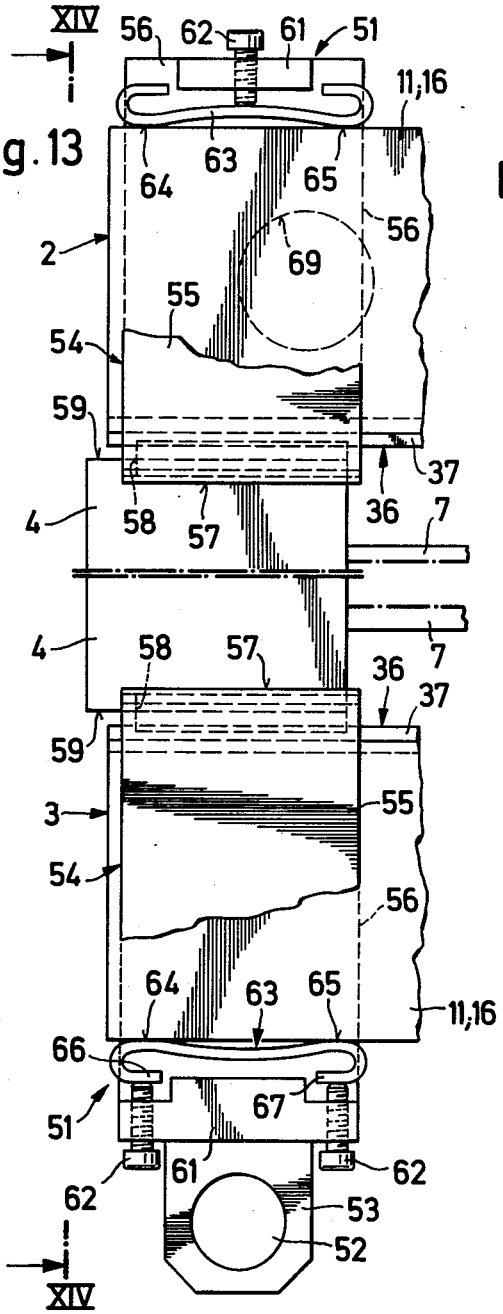
FIG. 13 illustrates on an enlarged scale details of the left end of the harness frame of the loom harness shown in FIG. 12.
Figure 14:
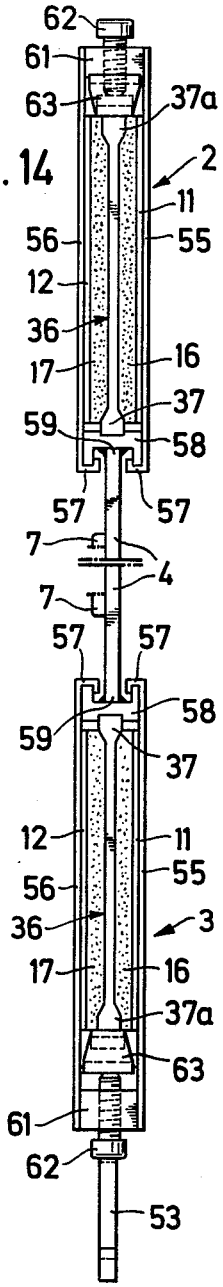
FIG. 14 is a sectional view of the harness frame illustrated in FIG. 13, taken substantially along the respective lines XIV—XIV of FIGS. 12 and 13.

With the mounting or clamping device 51 arranged at the lower portion of FIGS. 13 and 14, and which serves for fixing the eyelet member 53 to the longitudinal beam 3, there are employed two clamping bolts or screws 62 which act at both flexed ends 66 and 67 of the spring 63. The eyelet or eyelet member 53, with this construction of loom harness, is formed of one piece together with the head piece 61.

Figure 16:
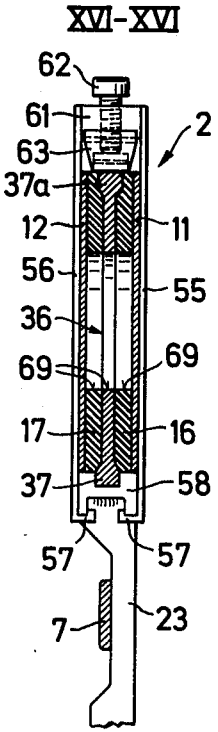
FIG. 16 is a sectional view of the harness frame of the loom harness shown in FIG. 12, taken substantially along the respective lines XV—XV of FIGS. 12 and 15.
Figure 15:
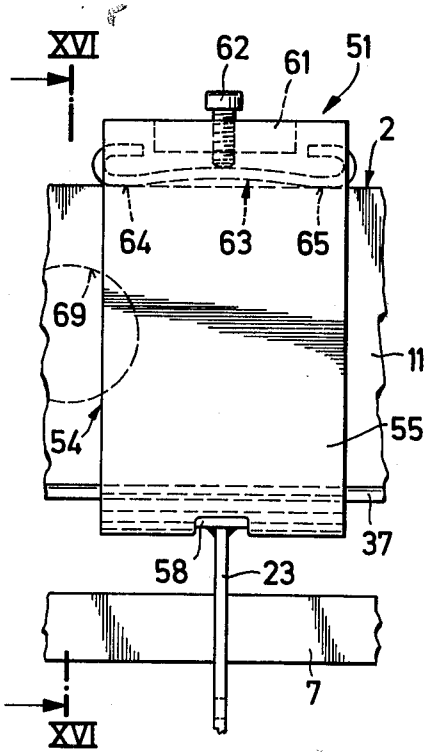
FIG. 15 is a fragmentary front view of a portion of the harness frame located to the right of the line XV—XV of FIG. 12.

In FIGS. 15 and 16 there is shown the mounting of the intermediate strut 23 at the longitudinal beam 2. The elastic intermediate elements or bodies 16 and 17 as well as the holder plate or rail 36, with this embodiment, are advantageously provided with a recess 69 or the like for the purpose of reducing weight.

Figure 17:
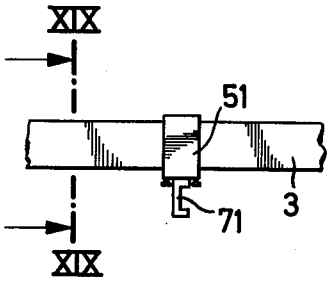
FIG. 17 illustrates a detail of a modified construction of loom harness.
Figure 19:
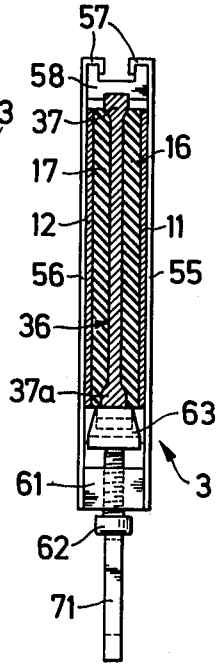
FIG. 19 is a sectional view of such harness frame, taken substantially along the lines XVIII—XVIII of FIGS. 17 and 18.
Figure 18:
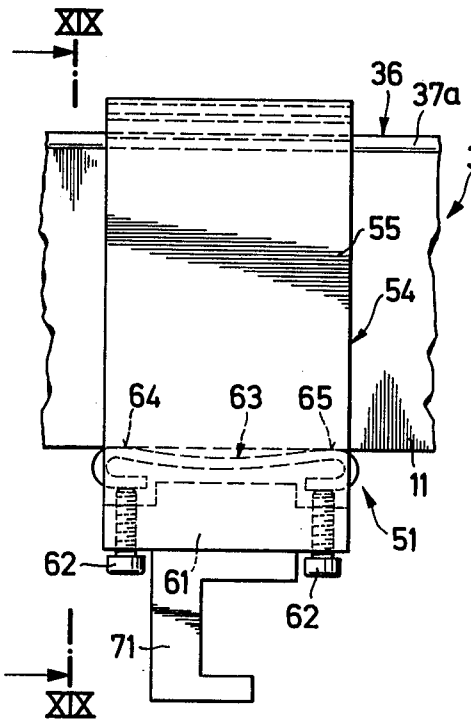
FIG. 18 illustrates on an enlarged scale a detail of the portion of the harness frame to the right of the line XVIII—XVIII of FIG. 17.

FIGS. 17 to 19 illustrate the mounting of the previously mentioned drive hook 71 at the frame beam 3 by means of a mounting device 51 which extensively corresponds to the construction discussed in conjunction with FIGS. 13 and 14. As also previously explained, a suitable counter-hook or other appropriate device can engage with the hook 71, this counter-hook being attached for instance to an up-and-down moving drive hook or lifter.

Although for the purpose of simplifying the illustration there is here not particularly shown the mounting of the holder elements 6 for the heddle rails 7, such can be carried out, however, by a mounting or clamping technique similar to that discussed with respect to the arrangements considered in conjunction with FIGS. 13 to 19.

By means of the sleeve or collar 54 the relevant member or element 4, 23, 53, or 71 which is to be secured to one of the associated longitudinal beams 2 and 3 is drawn against the holder plate 36 and clamped at both enlarged portions 37, 37*a* against such holder plate 36. The force flux from the longitudinal beams 2, 3 i.e., their walls 11, 12 to the holder plate 36 and the members 4, 23, 53 and 71 clamped or mounted thereat, always occurs exclusively through the agency of the elastomeric intermediate elements or bodies 16, 17, whereby there is obtained an elastic mounting and attachment of such members 4, 23, 51 and 71.

Figure 20:
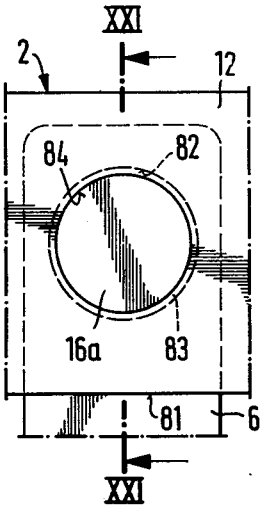
FIG. 20 illustrates in front view part of a harness frame of a further embodiment of loom harness.
Figure 21:
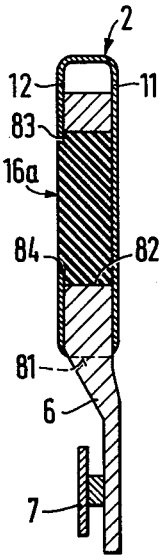
FIG. 21 is a sectional view thereof, taken substantially along the line XXI—XXI of FIG. 20.

The embodiment of harness shown in FIG. 20 comprises a harness frame having a top or upper longitudinal beam 2, which possesses two longitudinal or lengthwise extending support walls 11 and 12. Inserted through a lower opening 81 is a holder element 6 for a heddle support rail 7. The holder element 6 possesses a recess 82 which encloses an intermediate element or body 16*a* formed of an elastic or elastomeric material, for instance rubber. This intermediate element 16*a* is seated by means of a shoulder or protuberance 83 in an appropriate bore or opening 84 of the wall 12. The intermediate or body 16*a* can be, for instance, adhesively bonded to the wall 11 as well as in the bore 84.

Figure 22:
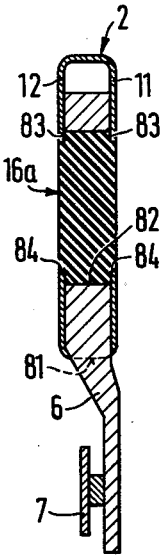
FIG. 22 is a sectional view, like the showing of FIG. 21, of a modification of the embodiment of FIG. 21.

With the slightly modified embodiment of FIG. 22, also the wall 11 contains a bore 84 and the intermediate element or body 16*a* has an appropriately configured second shoulder 83 by means of which it is held in this bore 84. As before the second shoulder 83 also can be adhesively bonded in its bore or opening 84.

Figure 23:
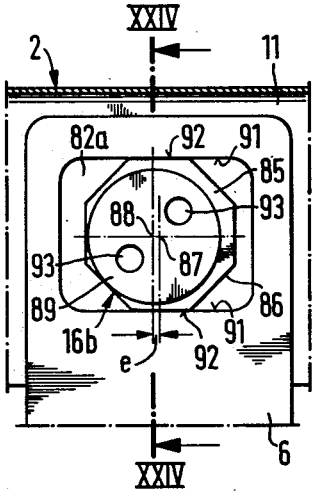
FIG. 23 is a front view of part of a harness frame of a still further embodiment of loom harness.
Figure 24:
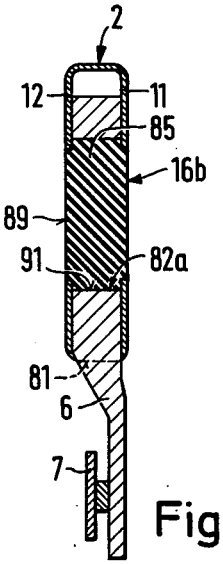
FIG. 24 is a sectional view thereof, taken substantially along the line XXIV—XXIV of FIG. 23.

With the embodiment of harness frame shown in FIGS. 23 and 24, the elastic intermediate element or body 16*b* includes an eccentric portion 85 with an octagonal-shaped periphery or outer surface 86. The eccentricity of the center 87 of such eccentric portion or part 85 relative to the center 88 of a concentric portion or part 89 has been designated by reference character *e*.

A recess 82*a* of the holder element 6 is of essentially rectangular configuration and engages by means of both its surfaces 91 with the surfaces 92 of the eccentric portion or eccentric 85.

The intermediate element or body 16*b* possesses two bores 93 for the insertion of a suitable tool to enable rotating such intermediate body within the longitudinal beam 2. As a result, the holder element 6, after selective incremental rotation of body 16*b*, for instance in the clockwise direction of FIG. 23, can be moved further downwards and locked in a new position. Rotation of the intermediate element or body 16*b* is possible, notwithstanding the presence of the essentially linear or straight surfaces 92, owing to its elastic properties.

Figure 25:
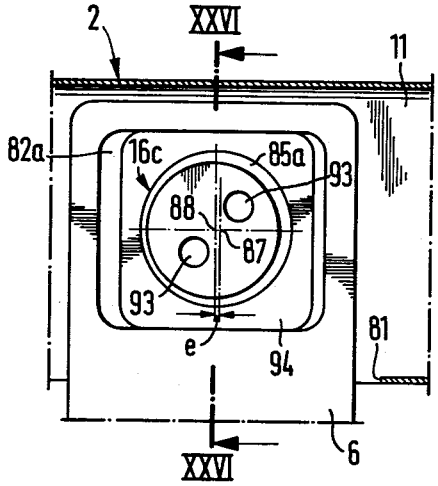
FIG. 25 is a front view of part of a still further embodiment of a harness frame of a loom harness constructed according to the present invention.
Figure 26:
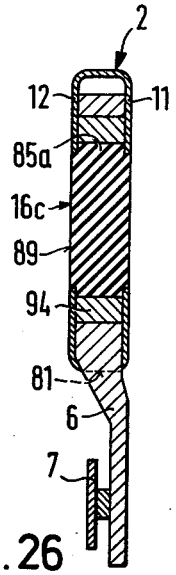
FIG. 26 is a sectional view thereof, taken substantially along the line XXVI—XXVI of FIG. 25.

With the embodiment of FIGS. 25 and 26 the eccentric portion or part 85*a* of the elastic intermediate element or body 16*c* is of substantially circular configuration at its periphery and is surrounded by a slide 94 which is horizontally shiftable in recess 82*a* of the holder element 6. Upon rotation of the intermediate element 16*c*, and with an accompanying to-and-fro movement of the slide 94, the holder element 6 is moved up-and-down. It is therefore infinitely adjustable.

Figure 27:
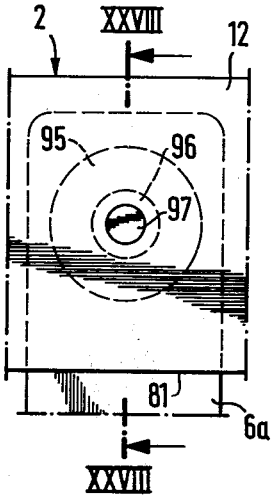
FIG. 27 is a front view of part of a harness frame according to another embodiment.
Figure 28:
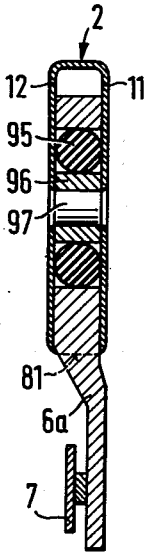
FIG. 28 is a sectional view thereof, taken substantially along the line XXVIII—XXVIII of FIG. 27.

With the embodiment of FIGS. 27 and 28 the elastic intermediate element is constructed as a ring or ring member 95 which, while interposing a bushing 96, can be attached by means of a rivet 97 or other suitable fastener member at the walls 11 and 12 of the loom harness.

Figure 29:
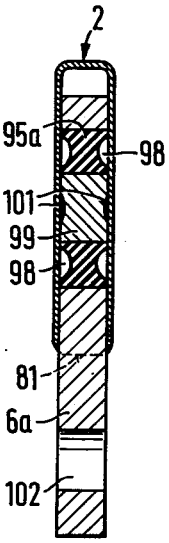
FIGS. 29 and 30 show in sectional view respective variant embodiments of the harness frame of the loom harness shown in FIG. 28.

With the further modification of FIG. 29, a ring 95*a* possesses substantially ring-shaped recesses 98 which increase the deformation capability of the ring 95*a* the harness frame beam 2. A pin or plug 99 is arranged within the ring 95*a*, this pin 99 being secured, as by welding, at locations 101 to the beam walls. The holder element 6*a*, with this embodiment, includes a lower bore 102 at which there can be articulated for instance a drive hook or lifter for the harness motion.

Figure 30:
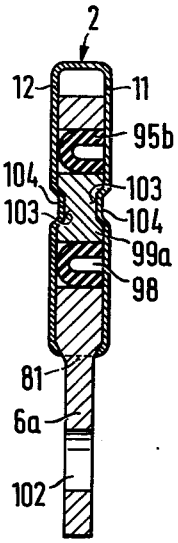

With the embodiment of FIG. 30, the ring 95*b* possesses a substantially U-shaped cross-sectional configuration, as shown. A pin 99*a* arranged within ring 95*b* is provided at both of its opposite sides with a recess or depression 103 into which there can be pressed both of the central portions 104 of the beam walls 11 and 12, so that the parts 95*b* and 99*a* are positionally fixed or retained.

Figure 31:
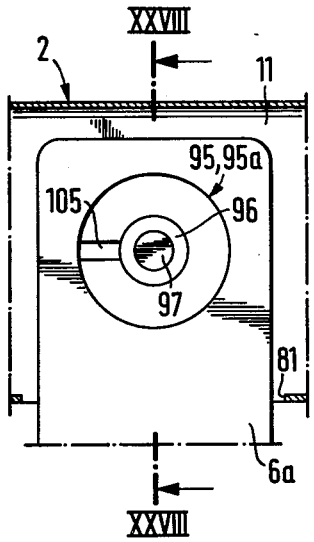
FIGS. 31 and 32 show in respective front views part of still further variants, from the showing a FIG. 27, of harness frames of loom harnesses constructed according to the present invention.
Figure 32:
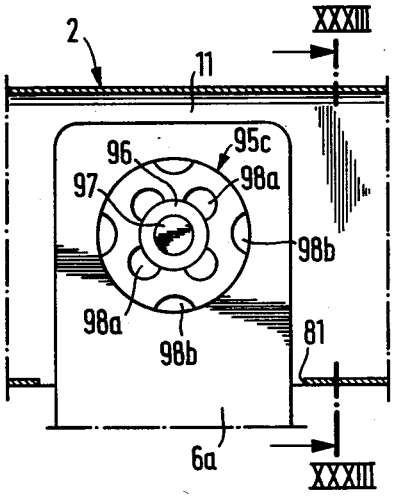
Figure 33:
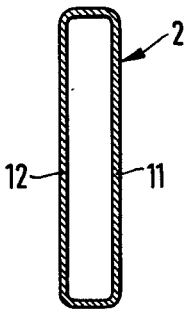
FIG. 33 is a sectional view of the harness frame shown in FIG. 32, taken substantially along the line XXXIII—XXXIII thereof.

With the arrangement of FIG. 31 the ring, which may be substantially like the rings 95 and 95*a* of FIGS. 27 and 29, respectively is additionally slotted at located 105, and with the embodiment of FIG. 32 the ring or ring member 95*c* possesses different recesses 98*a* and 98*b*. Finally, FIG. 33 shows the hollow shape of the portion of the harness frame beam 2 against the holder element 6*a* of FIG. 32.

The force flux is always transmitted between the relevant harness frame beam, such as beam 2 and the related holder element 6, 6*a* via an elastic intermediate element or body 16*a*, 16*b*, 16*c*, 95, 95*a*, 95*b*, 95*c*, as the case may be, thereby providing a protective attachement for the holder element and the members to be mounted thereat, such as for instance heddle rails 7, drive hooks or lifters, transverse struts of the frame and so forth.

Finally, it is mentioned by way of completeness that to the extent possible and when desired features of one embodiment may be utilized in another embodiment of loom harness as herein disclosed and as will readily suggest itself to those skilled in this art.

While there are shown and described present preferred embodiments of the invention, it is to be distinctly understood that the invention is not limited thereto, but may be otherwise variously embodied and practiced within the scope of the following claims. Accordingly,

What I claim is:

1. A loom harness including a harness frame adapted for to-and-fro movement comprising:

a pair of spaced longitudinal beams defining top and bottom rails;

a pair of transverse beams defining side struts for said top and bottom rails;

at least one holder element carried by one of the longitudinal beams for mounting thereat a member;

at least one elastic intermediate element means interposed between the holder element and said one longitudinal beam carrying said holder element for transmitting tensile and compressive force flux between the holder element and said one longitudinal beam during the to-and-fro movement of the harness frame.

2. The loom harness as defined in claim 1, wherein: said elastic intermediate element means is formed of rubber.

3. The loom harness as defined in claim 1, wherein:

said one beam longitudinal at which there is carried said holder element includes at least at a part thereof an internal hollow section;

said holder element being at least partially arranged within said hollow section of said one longitudinal beam; and a respective elastic intermediate element means disposed to each of said holder element at the location where said holder element is arranged within the hollow section of said one longitudinal beam.

4. The loom harness as defined in claim 1, wherein:

said holder element comprises a profile rail;

said profile rail having a lengthwise extending edge possessing an enlarged portion at which there can be displaceably and fixedly clamped said member to be mounted at said holder element.

5. The loom harness as defined in claim 4, wherein:

said enlarged portion possesses a substantially dovetail-shaped configuration;

a displaceable element mounted and fixedly clampable upon said dovetail-shaped enlarged portion and capable of receiving said member to be mounted at the holder element; and means for fixedly clamping said displaceable element at said dovetail-shaped enlarged portion.

6. The loom harness as defined in claim 1, further including:

a mounting device for the member;

said mounting device including means for mounting the same at respective sides of the holder element which confront and face away from said mounting device.

7. The loom harness as defined in claim 6, wherein:

said means of said mounting device comprises a sleeve surrounding the longitudinal beam carrying said mounting device;

said member mounted at said holder element being inserted through said sleeve towards one side of the holder element;

said sleeve bearing against an opposite side of said holder element.

8. The loom harness as defined in claim 7, wherein:

said member is provided with a base;

said sleeve having two bent ends engaging about said base and urging said base against said one side of said holder element;

a head piece provided for said sleeve;

clamping means cooperating with said head piece for urging said sleeve at said opposite side of said holder element to be supported at said holder element.

9. The loom harness as defined in claim 7, wherein:

said mounting device includes a resilient member arranged at least at one predetermined side of the holder element.

10. A loom harness including a harness frame adapted for to-and-fro movement comprising:

a pair of spaced longitudinal beams defining top and bottom rails;

a pair of transverse beams defining side struts for said top and bottom rails;

at least one holder element carried by one of the longitudinal beams for mounting thereat a member, said member comprising one of a heddle rail, an intermediate strut and a side strut;

elastic intermediate element means interposed and connected between said holder element and said one longitudinal beam for transmitting tensile and compressive forces between said holder element and said one longitudinal beam generated by the to-and-fro movement of the harness frame.

11. The loom harness as defined in claim 10, wherein said tensile and compressive forces are transmitted solely by said elastic intermediate element means.

* * * * *